US010017286B2

(12) United States Patent
Py

(10) Patent No.: US 10,017,286 B2
(45) Date of Patent: Jul. 10, 2018

(54) SELF CLOSING AND OPENING FILLING NEEDLE, NEEDLE HOLDER, FILLER AND METHOD

(71) Applicant: Dr. Py Institute LLC, New Milford, CT (US)

(72) Inventor: Daniel Py, Larchmont, NY (US)

(73) Assignee: DR. PY INSTITUTE LLC, New Milford, CT (US)

( * ) Notice: Subject to any disclaimer, the term of this patent is extended or adjusted under 35 U.S.C. 154(b) by 64 days.

(21) Appl. No.: 14/708,196

(22) Filed: May 9, 2015

(65) Prior Publication Data

US 2015/0321780 A1 Nov. 12, 2015

Related U.S. Application Data

(60) Provisional application No. 61/991,561, filed on May 11, 2014, provisional application No. 61/991,467, filed on May 10, 2014.

(51) Int. Cl.

| | |
|---|---|
| ***B65B 39/00*** | (2006.01) |
| ***B65B 43/54*** | (2006.01) |
| ***B65B 3/04*** | (2006.01) |
| ***B65B 55/24*** | (2006.01) |
| ***B65B 39/12*** | (2006.01) |
| ***B65B 3/00*** | (2006.01) |
| *B65B 51/02* | (2006.01) |
| *B65B 51/10* | (2006.01) |

(52) U.S. Cl.

CPC ..... *B65B 43/54* (2013.01); *B65B 3/003* (2013.01); *B65B 3/04* (2013.01); *B65B 39/001* (2013.01); *B65B 39/004* (2013.01); *B65B 39/12* (2013.01); *B65B 55/24* (2013.01); *B65B 51/02* (2013.01); *B65B 51/10* (2013.01)

(58) Field of Classification Search

CPC .. A61J 1/14; A61J 1/201; A61J 1/2072; A61J 1/2086; A61J 1/2096; B65B 1/04; B65B 3/003; B65B 3/04; B65B 43/54; B65B 339/001; B65B 39/004; B65B 39/12

USPC ..... 604/411, 415

See application file for complete search history.

(56) References Cited

U.S. PATENT DOCUMENTS 2,839,094 A 6/1958 Reno
4,576,211 A * 3/1986 Valentini ..... A61J 1/2096 141/329

(Continued)

*Primary Examiner* — Timothy L Maust
*Assistant Examiner* — Andrew Schmid
(74) *Attorney, Agent, or Firm* — McCarter & English, LLP

(57) ABSTRACT

An apparatus for filling a device having a penetrable septum and a sealed chamber. The apparatus includes a filling member engageable with the penetrable septum to penetrate the septum, port(s), and a closure. The closure and filling member are movable between (i) a first position wherein the closure closes the port(s), and (ii) a second position opening the port(s). The filling member and/or septum is movable relative to the other between (i) a first position wherein the filling member is spaced from the septum, and (ii) a second position wherein the filling member is penetrated through the septum and in communication with the sealed chamber. A locking device is movable between (i) a locked position locking the closure and/or filling member in the first position, and (ii) an unlocked position allowing movement of the closure and/or filling member relative to the other and into the second position.

35 Claims, 15 Drawing Sheets

(56) References Cited

U.S. PATENT DOCUMENTS

| | | | | |
|---|---|---|---|---|
| 5,641,004 | A | 6/1997 | Py | |
| 6,360,794 | B1 | 3/2002 | Turner | |
| 2004/0222224 | A1 | 11/2004 | Plester | |
| 2007/0277904 | A1 | 12/2007 | Martin | |
| 2012/0241042 | A1* | 9/2012 | Strangis | B65B 7/28 141/2 |
| 2012/0261027 | A1 | 10/2012 | Py | |
| 2013/0225903 | A1 | 8/2013 | Franci et al. | |
| 2013/0270820 | A1 | 10/2013 | Py | |
| 2013/0333796 | A1 | 12/2013 | Py | |

* cited by examiner

SELF CLOSING AND OPENING FILLING NEEDLE, NEEDLE HOLDER, FILLER AND METHOD

CROSS-REFERENCE TO RELATED APPLICATIONS

This patent application claims benefit under 35 U.S.C. § 119 to similarly-titled U.S. Provisional Patent Application Nos. 61/991,467, filed May 10, 2015, and 61/991,561, filed May 11, 2015, which are hereby incorporated by reference in their entireties as part of the present disclosure.

FIELD OF THE INVENTION

The present invention relates to devices and methods for sterile or aseptic filling of substances, such as liquids, gels, creams, gases or powders, into devices or containers, and more specifically, to such devices and methods that sterile or aseptic fill closed containers and devices.

BACKGROUND INFORMATION

The present inventor has invented devices and methods for sterile filling a closed container or other device through a septum with a filling needle or other filling member. The filling needle or other filling member defines one or more filling ports that are normally sealed with respect to ambient atmosphere by a closure. The closure is movable between (i) a first position wherein the closure closes the ports and forms a fluid-tight seal between the ports and ambient atmosphere to maintain sterility of the ports and the interior of the filling member, and (ii) a second position opening the ports to allow substance to pass between the interior and exterior of the filling member. In such devices and methods, it may be undesirable to allow the closure to move from the first or closed position sealing the ports to the second or open position unsealing the ports, prior to placing the ports in fluid communication with the sterile chamber to be filled. Such premature opening of the closure could lead to contamination of the ports or other sterile or aseptic portions of the filling member by bacteria, germs or other contaminants located in the ambient atmosphere or on the device to be filled. Accordingly, it is an object of the present disclosure to overcome such potential drawback or disadvantage.

SUMMARY OF THE INVENTION

In accordance with a first aspect, the present invention is directed to an apparatus for filling a device including a penetrable septum and a sealed chamber in fluid communication with the penetrable septum. The apparatus includes a hollow filling member, a penetrating tip formed at one end of the filling member that is engageable with the penetrable septum to penetrate the septum, one or more ports in fluid communication between an interior of the hollow filling member and an exterior of the hollow filling member, and a closure. The closure and/or filling member is movable between (i) a first position wherein the closure closes the port(s) and forms a fluid-tight seal between the port(s) and ambient atmosphere to maintain sterility of the port(s) and an interior of the filling member, and (ii) a second position opening the port(s) to allow substance to pass between the interior and exterior. The filling member and/or septum is movable relative to the other between (i) a first position wherein the penetrating tip is spaced from the septum, and (ii) a second position wherein the penetrating tip is penetrated through the septum and in communication with the sealed chamber of the device. A locking device is movable between (i) a locked position locking the closure and/or filling member in the first position, and (ii) an unlocked position allowing movement of the closure and/or filling member relative to the other and into the second position.

Some embodiments of the invention further include a filling member mount, wherein the hollow filling member is mountable thereto. The filling member mount is movable with the filling member between the first and second positions. In some such embodiments, the filling member mount drives the filling member between the first and second positions.

In some embodiments of the invention, the locking device includes a compression plate engageable with the closure, and the filling member mount and/or compression plate is movable relative to the other. In some embodiments, the locking device further includes a cam movable between (i) the locked position preventing movement of the filling member relative to the compression plate and closure, and (ii) the unlocked position allowing movement of the filling member relative to the compression plate and closure. In some such embodiments, the cam defines a plurality of unlocked positions depending on the degree of movement of the filling member relative to the compression plate and closure. In some such embodiments, the filling member mount includes a bearing member, and the cam is pivotally mounted adjacent to and engageable with the bearing member. In some such embodiments (i) in the locked position, the cam is engaged with the bearing member and the compression plate to prevent movement of the compression plate relative to the filling member mount, and (ii) in the unlocked position, the cam is movable relative to the bearing member to allow movement of the filling member mount and/or compression plate relative to the other. In some such embodiments, the locking device includes a spring that biases the locking device into the locked position. In some embodiments, a cam is pivotally mounted, the compression plate is biased against the closure, and the filling member is movable relative to the closure against the bias of a spring. In some such embodiments, the cam includes a bearing member that facilitates pivotal movement of the cam against the bias of the spring and movement of the filling member relative to the closure.

Some embodiments of the present invention further include a device mount, wherein the device is mountable thereto. In some such embodiments, the filling member mount is movable relative to the device mount between (i) the first position, wherein the penetrating tip is spaced from the septum, and (ii) the second position, wherein the penetrating tip is penetrated through the septum and in communication with the chamber of the device. In some such embodiments, during a first phase of penetration of the septum by the penetrating tip, the locking device is in the locked position, and during a second phase of penetration, the locking device is in the unlocked position. In some such embodiments, the closure defines a tip at the juncture of the closure and penetrating tip, and the septum defines an interior surface in communication with the interior of the chamber. During the second phase of penetration, the tip of the closure is located within the septum and is prevented from penetrating through the interior surface.

In some embodiments of the invention, the device mount includes a stop engageable with at least one of the closure and compression plate to prevent further movement of the closure in the direction from the first position toward the second position. During the first phase of penetration, neither the closure nor the compression plate is engaged with the stop. During the second phase of penetration, the closure and/or compression plate is engaged with the stop. In some embodiments, the cam includes a first end engageable with a bearing member, and a second end engageable with the device mount. In some such embodiments, during the second phase of penetration, the second end of the cam engages the bearing member and pivots the cam relative to the bearing member with further movement in the direction from the first position toward the second position. In some embodiments, the cam includes a second bearing mounted on the second end thereof, and engageable with the device mount to facilitate movement of the cam relative to the device mount. In some such embodiments, the cam is pivotally mounted on the filling member mount, and includes a bearing engageable with the compression plate, and a spring that biases the cam into the locked position, and that allows pivotal movement of the cam relative to the compression plate against the bias of the spring in the unlocked position. In some embodiments of the invention, the septum defines an interior surface in fluid communication with the chamber. The stop prevents movement of the closure through the interior surface of the septum, but allows movement of the penetrating tip and port(s) through the interior surface and into fluid communication with the chamber.

In accordance with another aspect, the present invention is directed to an apparatus for filling a device with a filling member assembly, wherein the device includes a penetrable septum and a sealed chamber in fluid communication with the penetrable septum. The filling member assembly includes a hollow filling member, a penetrating tip formed at one end thereof that is engageable with the penetrable septum to penetrate the septum, one or more ports in fluid communication between an interior and an exterior of the filling member, and a closure. The closure and/or filling member is movable between (i) a first position wherein the closure closes the port(s) and forms a fluid-tight seal between the port(s) and ambient atmosphere to maintain sterility of the port(s) and an interior of the filling member, and (ii) a second position opening the port(s) to allow substance to pass between the interior and exterior. The filling member and/or septum is movable relative to the other between (i) a first position wherein the penetrating tip is spaced from the septum, and (ii) a second position wherein the penetrating tip is penetrated through the septum and in communication with the sealed chamber of the device. The apparatus includes a locking device movable between (i) a locked position locking the closure and/or filling member in the first position, and (ii) an unlocked position allowing movement of the closure and/or filling member relative to the other and into the second position.

In accordance with another aspect, the present invention is directed to an apparatus for filling a device including a penetrable septum and a sealed chamber in fluid communication with the penetrable septum. The apparatus includes first means for filling that is engageable with the penetrable septum for penetrating the septum, and second means for placing an interior of the first means in fluid communication with an exterior of the first means; and third means for closing and opening the second means. The third means and/or first means is movable between (i) a first position wherein the third means closes the second means and forms a fluid-tight seal between the second means and ambient atmosphere to maintain sterility of the second means and an interior of the first means, and (ii) a second position opening the second means to allow substance to pass between the interior and exterior. The first means and/or septum is movable relative to the other between (i) a first position wherein the first means is spaced from the septum, and (ii) a second position wherein the first means is penetrated through the septum and the second means is in communication with the sealed chamber of the device. The apparatus further includes fourth means movable between (i) a locked position for locking at least one of the third means and first means in the first position, and (ii) an unlocked position for allowing movement of the third means and/or first means relative to the other and into the second position. In some such embodiments, the first means is a needle, the second means is a port, the third means is a closure, and the fourth means is a locking device.

In accordance with another aspect, the present invention is directed to a method of filling a device including a penetrable septum and a sealed chamber in fluid communication with the penetrable septum. The method includes the following steps:

- penetrating the septum with a penetrating tip of a hollow filling member including a port adjacent to the penetrating tip in fluid communication between an interior and an exterior of the hollowing filling member, and a closure;
- during a first phase of penetration of the septum, locking the filling member and/or closure in a closed position with the closure closing the port and forming a fluid-tight seal between the port and ambient atmosphere to maintain sterility of the port and an interior of the filling member;
- during a second phase of penetration of the septum, unlocking and allowing relative movement of the closure and/or filling member relative to the other, and opening the port into fluid communication with the chamber of the device; and
- introducing a flow of substance through the open port of the hollow filling member and into the device.

Some embodiments of the present invention further include terminating the flow of substance through the port, withdrawing the hollow filling member from the septum, and allowing the septum to reseal itself upon withdrawal of the hollow filling member therefrom.

Some embodiments of the present invention further include: (i) during a first phase of withdrawal, moving the filling member relative to the closure and into the closed position with the closure closing the port and forming a fluid-tight seal between the port and ambient atmosphere, to maintain sterility of the port and an interior of the filling member; and (ii) during a second phase of withdrawal, locking the filling member and/or closure in the closed position.

In some embodiments of the present invention, the closure defines a tip at the juncture of the closure and penetrating tip of the filling member, and the septum defines an interior surface in communication with the interior of the chamber. During the second phase of penetration, the tip of the closure is maintained within the septum and prevented from penetrating through the interior surface of the septum.

Some embodiments further include resealing the resulting penetration aperture in the septum by one or more of applying radiation, thermal energy, liquid sealant or a chemical agent thereto, or by mechanical resealing.

One advantage of the present invention, and/or of the currently preferred embodiments thereof, is that the closure is locked in the sealed position when not penetrating the septum, and preferably is locked in the sealed position during a first phase of penetrating the septum prior to penetrating the interior surface of the septum. Then, during a second phase of penetrating the septum, the position of the closure is fixed relative to the septum, the closure is preferably prevented from penetrating through the interior surface of the septum, and the closure and filling member are unlocked to, in turn, allow the filling member to move relative to the closure to open the port(s) into fluid communication with the interior chamber of the device. Preferably, the closure is unlocked to allow opening of the port(s) only when the port(s) can be opened in fluid communication with the interior of the chamber to be filled. As a result, contamination of the sterile or aseptic portions of the filling member is prevented.

Other advantages of the present invention, and/or of the currently preferred embodiments thereof, will become more readily apparent in view of the following detailed description of the currently preferred embodiments and accompanying drawings.

DETAILED DESCRIPTION OF CURRENTLY PREFERRED EMBODIMENTS

Figure 1A:
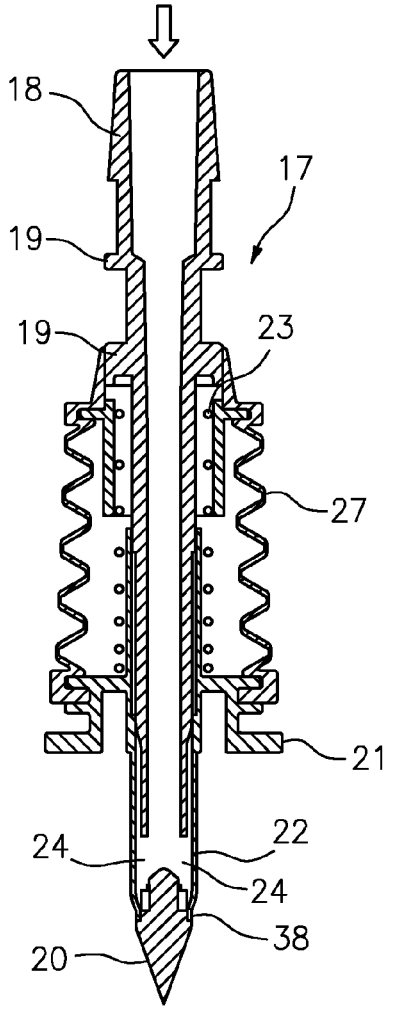
FIG. 1A is a cross-sectional view of a filling needle assembly including a hollow filling member or needle, and a closure or shutter.

The present application discloses an apparatus 10 (see FIGS. 2A and 3-15) for filling one or more devices 12 (see FIGS. 1B-1D, 2B-2E, and 3-15). As can be seen in FIGS. 1B-1D, a typical device 12 to be filled includes a penetrable septum 14 and a sealed chamber 16 in fluid communication with the penetrable septum 14. Typically, the apparatus 10 is used to sterile or aseptic fill the devices 12, and the devices define sterile chambers prior to filling. However, if desired, the apparatus may be employed to perform other functions, such as non-sterile filling. The devices 12 to be filled may take any of numerous different configurations that are currently known or that later become known, such as vials, syringes, pouches and other types of containers or dispensers, including single dose devices, multiple dose devices, devices with pumps and/or valves for dispensing product from storage chambers, etc. For example, as shown in FIGS. 2B-2E, the devices 12 are multiple-dose syringes, wherein each syringe includes a cylindrical-shaped body defining a storage chamber 16, and a sliding stopper 14 received within one end of the body that forms the penetrable septum. The sliding stopper 14 and cylindrical body cooperate to form a sealed, empty variable-volume storage chamber 16 prior to filling, and multiple-dose, variable-volume storage chamber after filling. As shown in FIGS. 3-15, the devices 12 to be filled alternatively may take the form of a flexible pouch defining a multiple-dose storage chamber 16, wherein the pouch includes a fitting with a penetrable and resealable stopper 14 mounted or otherwise formed therein defining the penetrable septum.

Figure 1B:
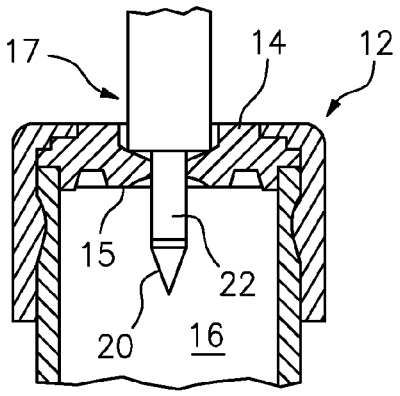
FIGS. 1B, 1C, and 1D are a series of perspective, partial cross-sectional views showing the filling member of FIG. 1A penetrating an elastic septum, wherein (i) the needle is closed by the shutter before and during piercing, as shown in FIG. 1B; (ii) product is filled only when the needle opens within the sterile chamber of the closed container, as shown in FIG. 1C; and (iii) the needle is closed by the shutter after filling and before withdrawal of the needle from the septum, as shown in FIG. 1D.
Figure 1C:
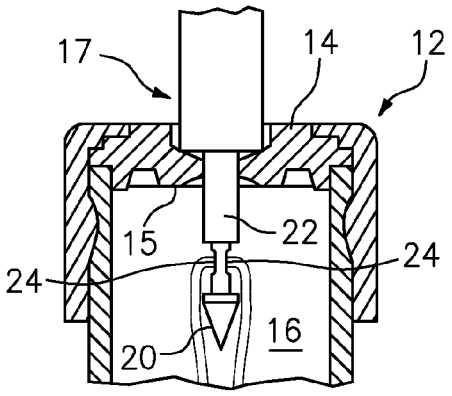
Figure 1D:
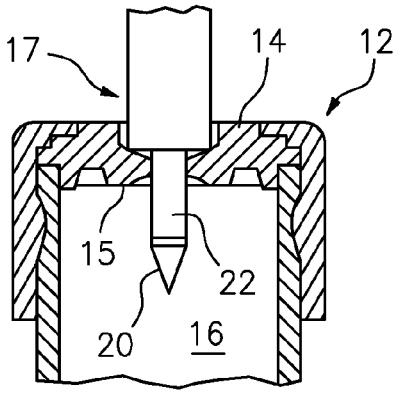
Figure 2A:
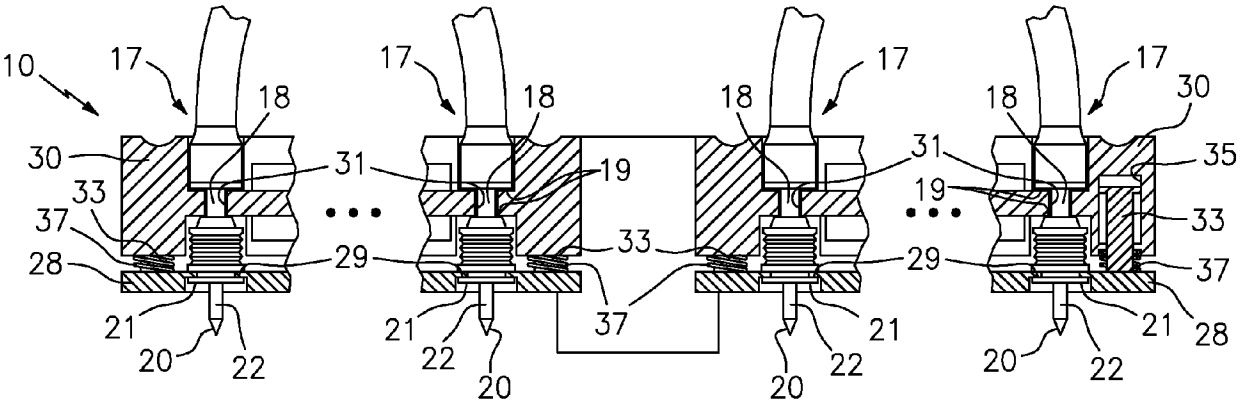
FIG. 2A is a partial cross-sectional view of one embodiment of a filling member mounting assembly of a filler, including several filling needle assemblies of the type shown in FIGS. 1A-1D mounted thereon, and with parts removed for clarity.
Figures 2B, 2C, 2D, 2E:
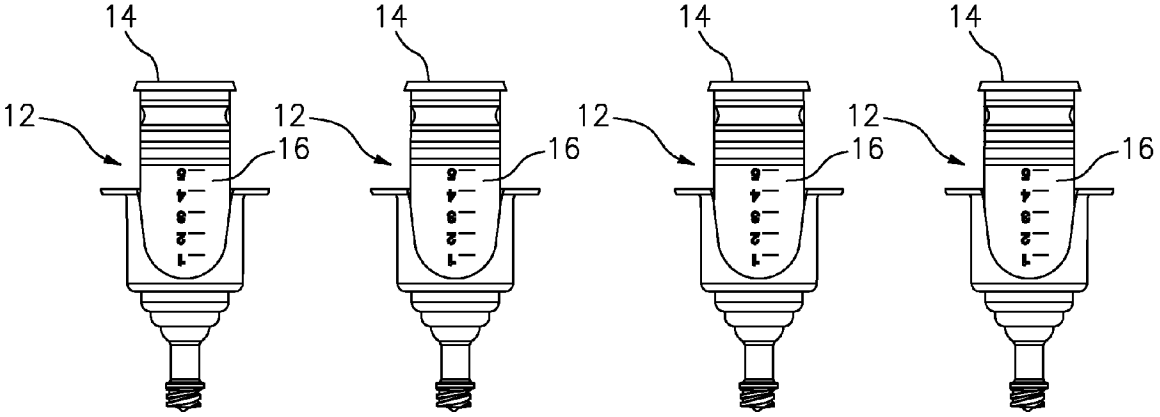
FIGS. 2B-2E are perspective views of the devices or containers that are filled by the needles in FIG. 2A, and which are closed syringes defining sealed, empty variable-volume storage chambers prior to filling, and multiple-dose, variable-volume storage chambers after filling.
Figure 3:
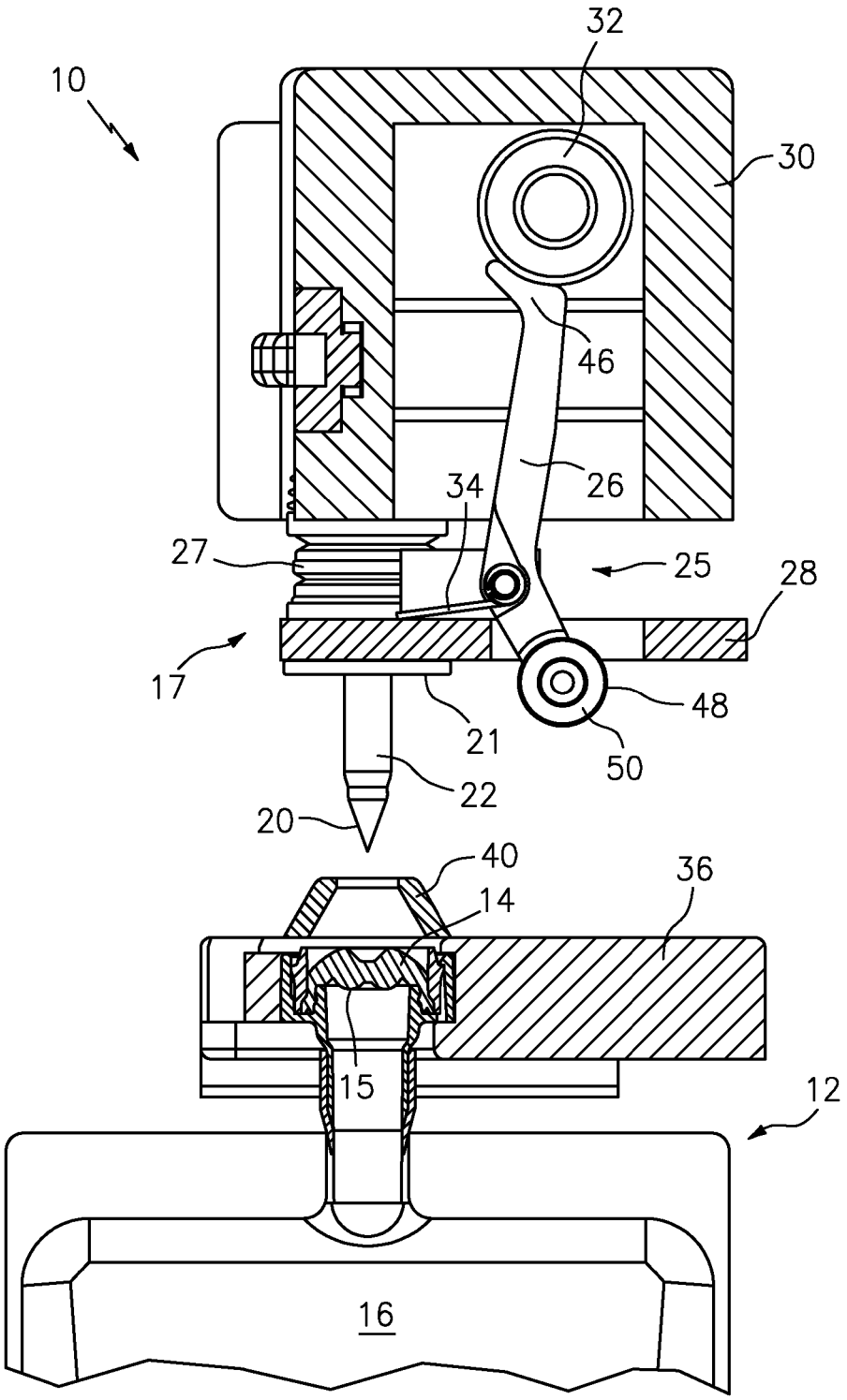
FIG. 3 is a side elevational, partial cross-sectional view of the filling member mounting assembly of the filler, the self-opening-closing needle, and an elastic septum of a device to be filled, which is a sealed, empty pouch.

As can be seen in FIGS. 1A and 2A, the apparatus 10 includes a plurality of filling needle assemblies 17. Each filling needle assembly 17 is mounted on the apparatus 10 and is driven by the apparatus into engagement with the penetrable septum 14 of a respective device 12 to fill a product into the sealed chamber 16 of the device. As shown in FIG. 1A, each filling needle assembly 17 includes a hollow filling member 18 defining a penetrating tip 20 at one end thereof, which is engageable with the penetrable septum 14 to penetrate the septum. Each filling needle assembly 17 also includes a shutter or closure 22, and one or more needle eyes or ports 24 (see FIGS. 1A, 1C, 9, and 10) in fluid communication between the interior and exterior of the hollow filling member. In the illustrated embodiment, each filling member 18 is a needle, the needle defines a pair of diametrically opposed needle eyes or ports 24, and the closure 22 is a sliding shutter. However, as may be recognized by those of ordinary skill in the pertinent art based on the teachings herein, the filling member or its assembly may take other forms that are currently known or that later become known, such as a filling cannula.

As shown typically in FIGS. 1B-1D, the filling member 18 is movable relative to the closure 22 between (i) a first position (see FIGS. 1B and 1D) wherein the closure 22 closes the port(s) 24 and forms a fluid-tight seal between the port(s) 24 and ambient atmosphere to maintain sterility of the port(s) and the interior of the filling member, and (ii) a second position (see FIG. 1C) opening the port(s) 24 to allow substance to pass between the interior and exterior of the filling member. The filling member 18 is movable relative to the septum 14 between (i) a first position (see, e.g., FIG. 3) wherein the penetrating tip 20 is spaced from, or is not penetrating, the septum 14, and (ii) a second position (see FIGS. 5-13) wherein the penetrating tip 20 is penetrated through the septum 14 and is in communication with the sealed chamber 16 of the device 12.

As can be seen in FIGS. 3-15, the apparatus 10 further includes a locking device 25 that is movable between (i) a locked position (see FIGS. 3-6 and 13-15) locking the closure 22 and the filling member 18 in the first position, and (ii) an unlocked position (see FIGS. 7-12) allowing movement of the closure 22 and/or filling member 18 relative to the other and into the second position. In the illustrated embodiment, the locking device 25 is formed by a pivoting cam 26 and a compression plate 28. However, as may be recognized by those of ordinary skill in the pertinent art based on the teachings herein, the locking device 25 may take any of numerous different configurations that are currently known, or that later become known.

The apparatus 10 further includes a filling member mount or holder 30, and each filling needle assembly 17 is mountable thereto. The filling member mount 30 is movable with each filling needle assembly 17 between the first and second positions. As can be seen in FIGS. 3-15, the filling member mount 30 drives each filling member assembly 17 between the first and second positions. As shown in FIG. 1A, each hollow filling member 18 includes a pair of spaced upper flanges 19, 19, and the closure 22 includes a lower flange 21, for mounting the needle assembly to the mount 30. The hollow filling member 18 is received through a coil spring 23 that is seated between a flange on the hollow filling member and the closure 22, and that normally biases the closure into the closed position. A bellows 27 surrounds the coil spring 23 and hollow filling member 18 to enclose the assembly and allow relative movement between the hollow filling member and closure.

As shown in FIG. 2A, an upper mounting surface 31 of the mount 30 is received between the spaced upper flanges 19, 19 of each hollow filling member 18 to fixedly secure the respective filling needle assembly to the mount. The lower flange 21 of each closure 22 is seated against a lower mounting surface 29 of the compression plate 28 to secure the respective closure and filling needle assembly to the compression plate. The compression plate 28 includes a plurality of spaced posts 33. Each post 33 is fixedly secured on one end to the compression plate, and as shown typically in FIG. 2A, is received on the other end within a respective bore 35 formed in the mount 30. As shown typically in FIG. 2A, each post 33 is received through a respective coil spring 37, and each coil spring is seated between the mount 30 and compression plate 28 to normally bias the compression plate in a direction away from the mount and into engagement with the lower flanges 21 of the closures 22.

As shown in FIGS. 3-15, the compression plate 28 is movable relative to the filling member mount 30 and is spring-biased into engagement with the lower flange 21 of each closure 22. Each cam 26 is pivotally mounted on the compression plate 28 and is movable between (i) the locked position (see FIGS. 3-6 and 13-15) preventing movement of the respective filling member 18 relative to the compression plate 28 and respective closure 22, and (ii) an unlocked position (see FIGS. 7-12) allowing movement of the respective filling member 18 relative to the compression plate 28 and respective closure 22. The filling member mount 30 includes a plurality of bearing members 32, and each cam 26 is pivotally mounted adjacent to and engageable with a respective bearing member 32. In the illustrated embodiment, each bearing member 32 is a roller bearing. However, as may be recognized by those of ordinary skill in the pertinent art based on the teachings herein, each bearing member 32 may take any of numerous different forms that are currently known, or that later become known. As can be seen in FIGS. 3-6, in the locked position, each cam 26 is engaged between the respective bearing member 32 and the compression plate 28 to prevent movement of the compression plate 28 relative to the filling member mount 30. As can be seen in FIGS. 7-10, in the unlocked position, each cam 26 is movable relative to the respective bearing member 32 to allow movement of the filling member mount 30 and/or the compression plate 28 relative to the other. Each cam 26 includes a spring 34 engaged with the compression plate 28 and normally biasing an upper end 46 of the cam into engagement with the respective bearing member 32 and into the locked position. In the illustrated embodiment, each spring 34 is a torsion spring that engages the compression plate on one end and the cam on another end. However, as may be recognized by those of ordinary skill in the art based on the teachings herein, this and other aspects of the locking device 25 may take any of numerous different configurations that are currently known or that later become known.

As can be seen in FIGS. 3-15, each device 12 to be filled is mounted on a carrier or device mount 36. The filling member mount 30 is movable relative to the device mount 36 between (i) the first position (see, e.g., FIG. 3), wherein each penetrating tip 20 is spaced from the respective septum 14, and (ii) a second position (see, e.g., FIG. 9), wherein each penetrating tip 20 is penetrated through the respective septum 14 and is in communication with the chamber 16 of the respective device 12. During a first phase of penetration of the septum 14 by the penetrating tip 20 (see FIGS. 4-6), the locking device 25 is in the locked position, and during a second phase of penetration (see FIGS. 7-10), the locking device 25 is in the unlocked position. Referring to FIG. 1A, each closure 22 defines a tip 38 at the juncture of the closure and the penetrating tip 20 of the filling member 18, and the septum 14 defines an interior surface 15 in communication with the interior of the chamber 16. As shown in FIGS. 7-10, during the second phase of penetration, the tip 38 of the closure 22 is located within the septum 14, the position of the closure 22 is fixed relative to the septum 14 and, preferably, the closure is prevented from penetrating through the interior surface 15 of the septum 14.

Figure 4:
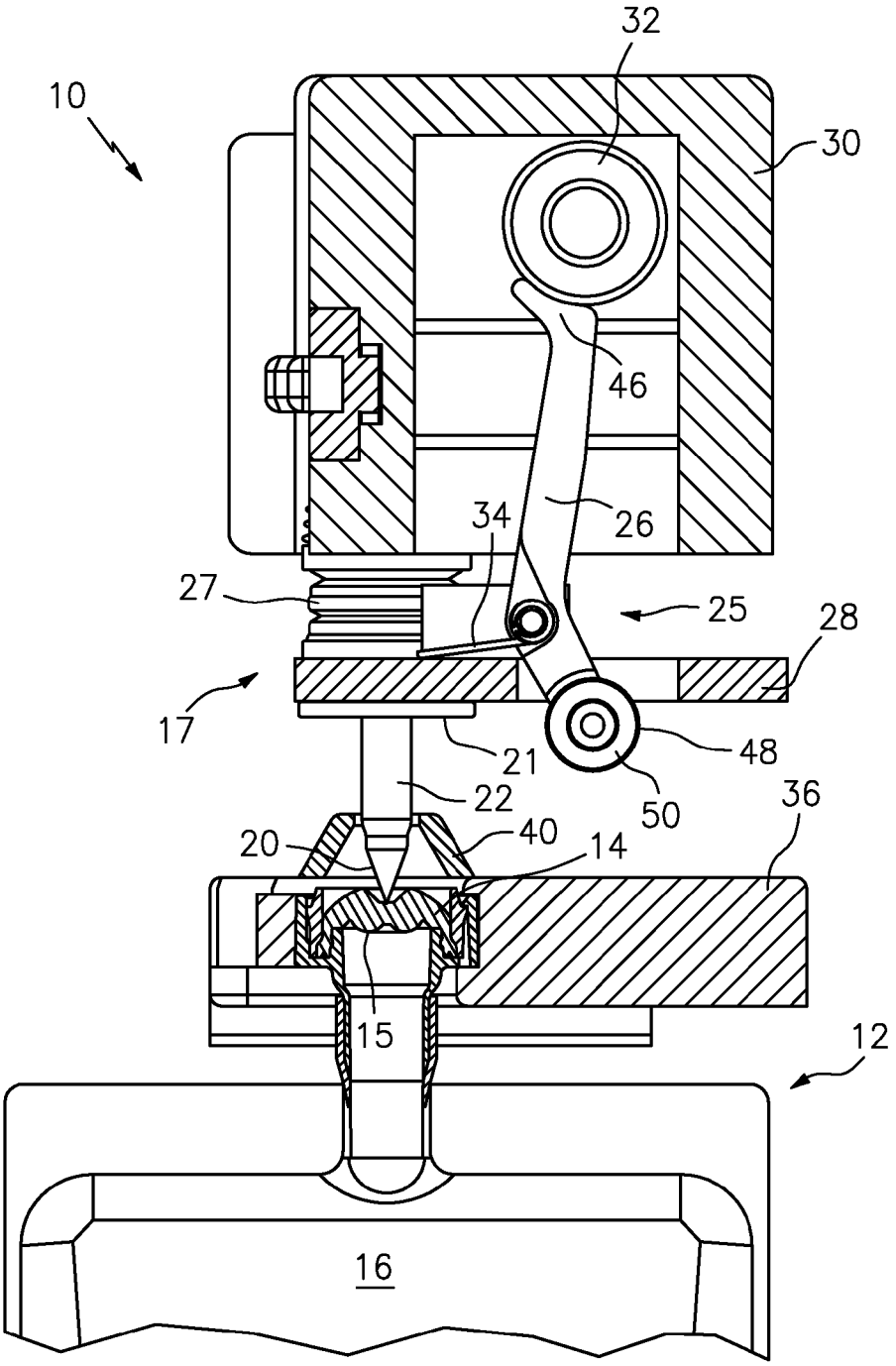
FIG. 4 shows the filling member mounting assembly, needle and septum during the first phase of penetration, with the shutter locked in the closed position.
Figure 5:
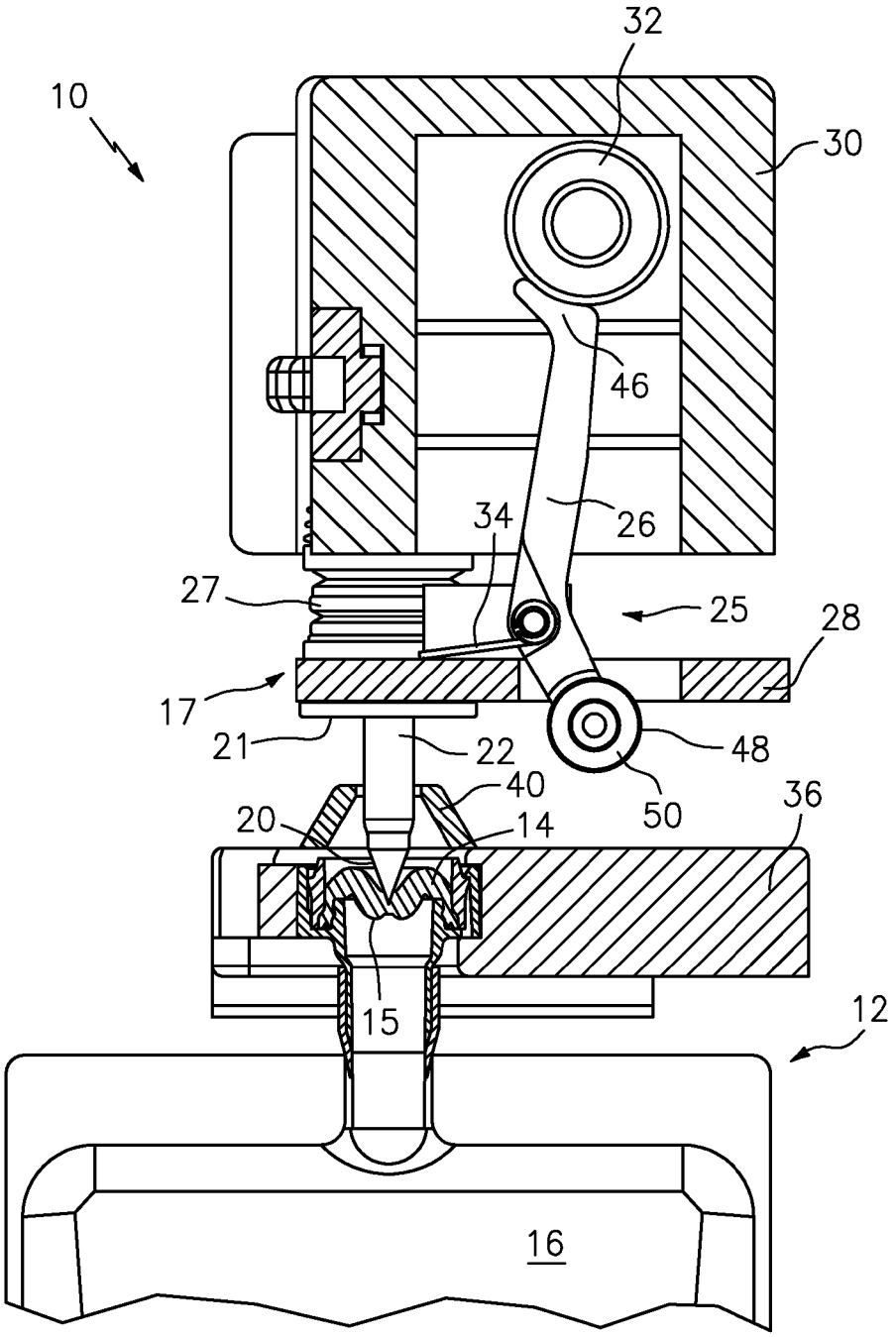
FIG. 5 shows the filling member mounting assembly, needle and septum during the first phase of penetration of the device septum, with the shutter locked in the closed position and the penetrating tip of the needle within the septum.
Figure 6:
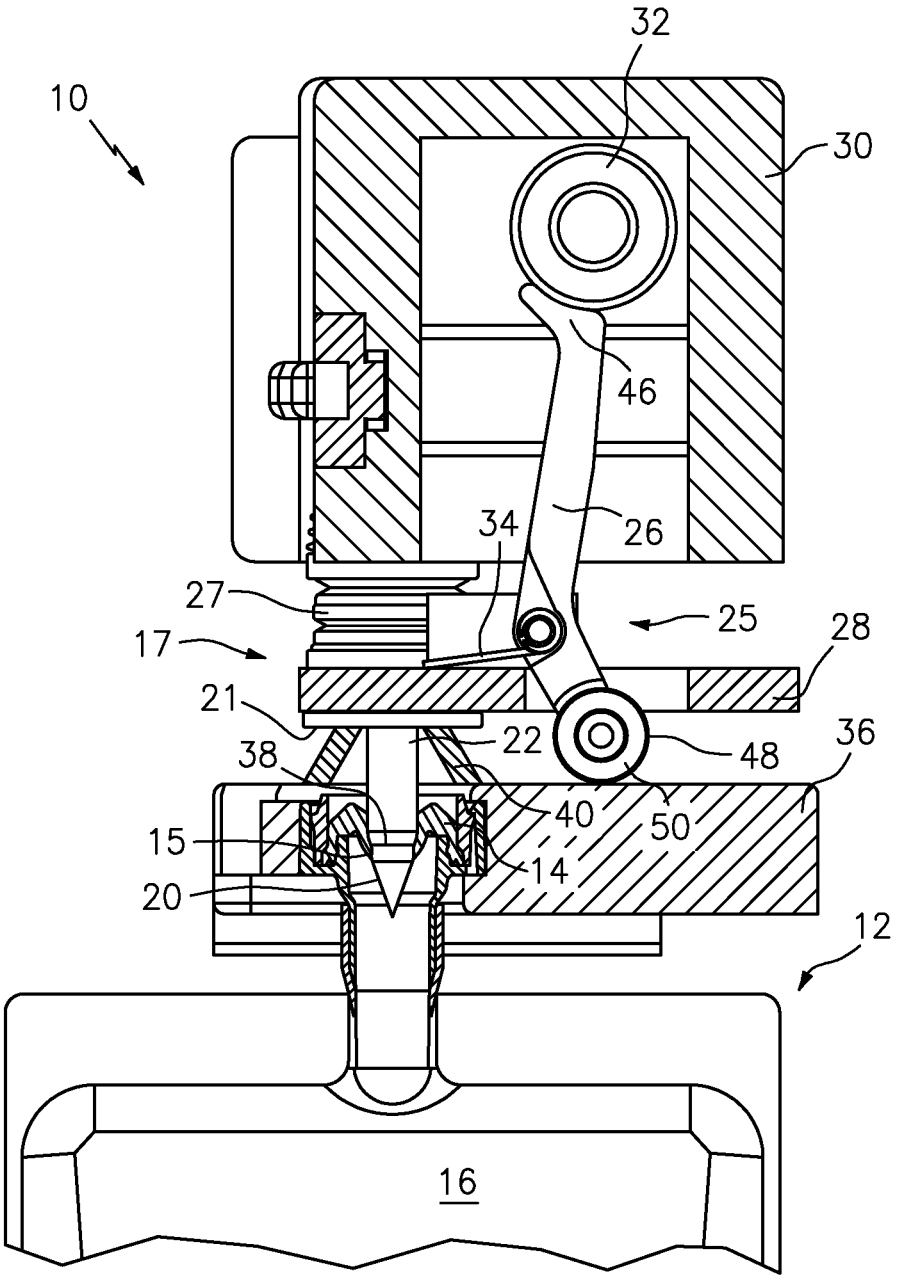
FIG. 6 shows the filling member mounting assembly, needle and septum during the first phase of penetration, with the shutter locked in the closed position and the penetrating tip of the needle penetrated through the septum.
Figure 7:
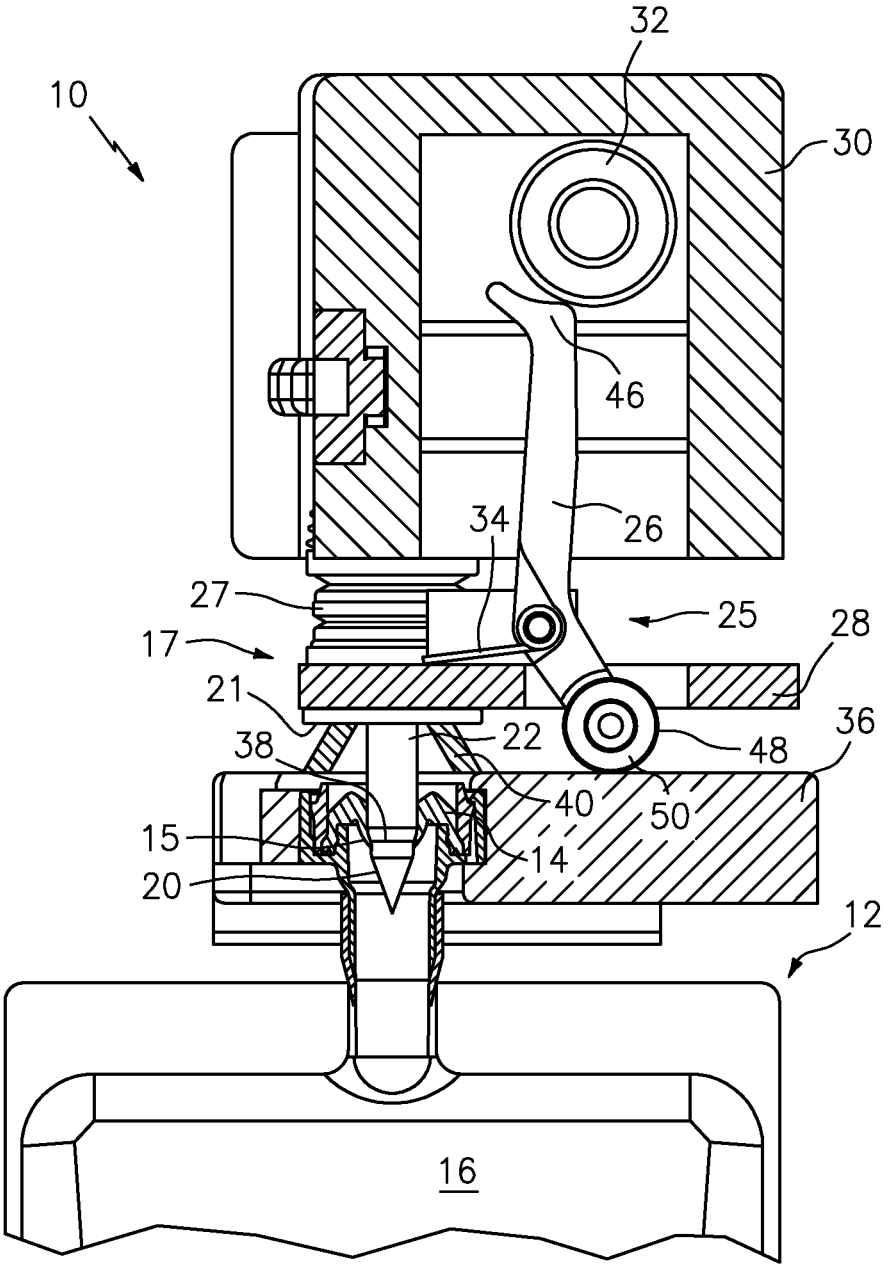
FIG. 7 shows the filling member mounting assembly, needle and septum during the second phase of penetration, wherein the cam slidably engages the device mount and moves into the unlocked position, the hollow needle is unlocked from the shutter and is, in turn, allowed to further penetrate and place the needle eyes or ports in fluid communication with the sterile interior of the device chamber.
Figure 8:
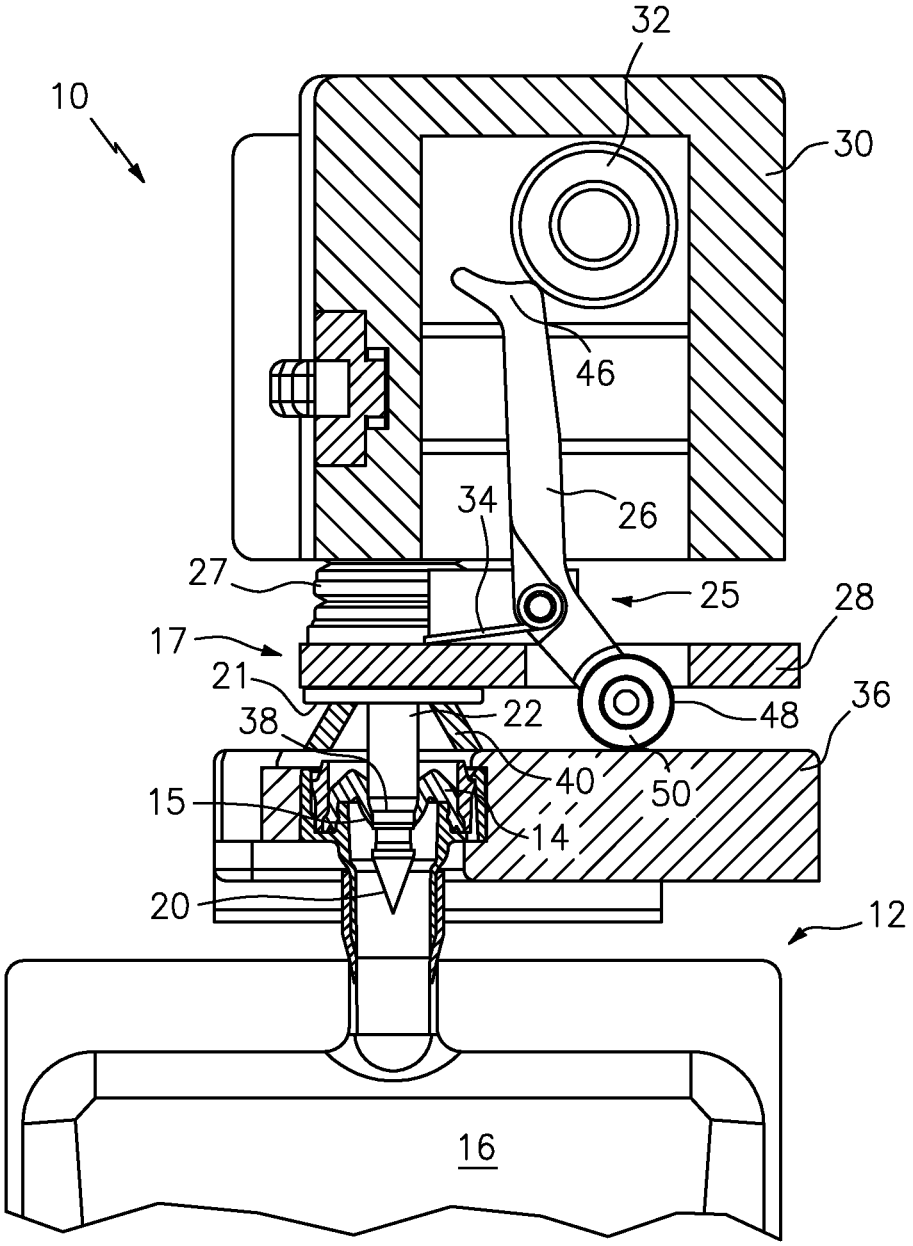
FIG. 8 shows the filling member mounting assembly, needle and septum during the second phase of penetration, wherein the hollow needle is unlocked from the shutter, but only when the needle eyes or ports are in, or can be opened into fluid communication with, the sterile interior of the device chamber.
Figure 9:
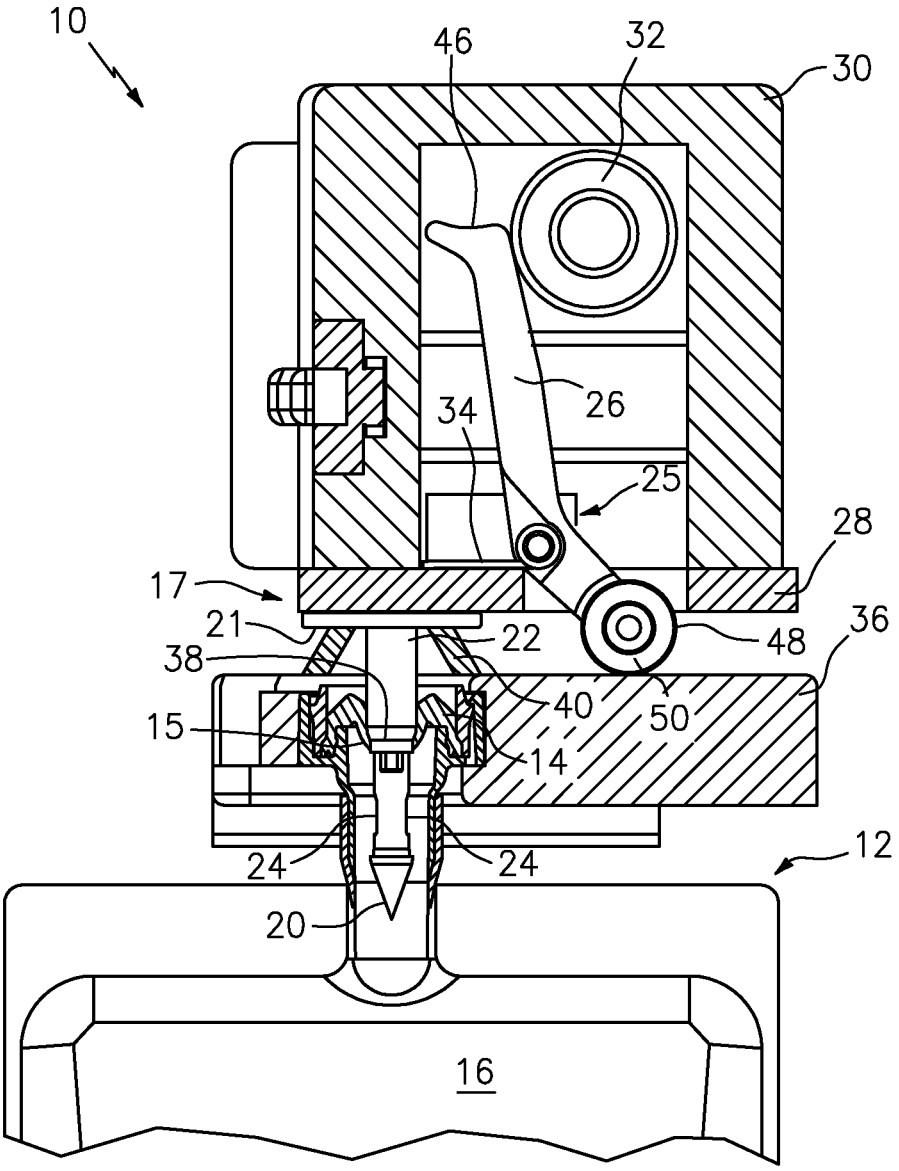
FIG. 9 shows the filling member mounting assembly, needle and septum during the second phase of penetration, with the needle fully penetrated into the sterile device chamber.

As shown in FIGS. 3-15, each device mount 36 includes a stop 40 engageable with the lower flange 21 of the respective closure 22 to prevent further movement of the closure in the direction from the first position toward the second position. In the illustrated embodiment, each stop 40 is a boss that surrounds the respective opening in the device mount 36 with the septum 14 of the device 12 received therein. As shown in FIGS. 4 and 5, during the first phase of penetration, neither the closure 22 nor the compression plate 28 is engaged with the stop 40. As shown in FIGS. 6-10, during the second phase of penetration, each closure 22 is engaged with the respective stop 40.

Each cam 26 includes a first or upper end 46 engageable with the respective bearing member 32, and a second or lower end 48 engageable with the device mount 36. As shown in FIGS. 6-10, during the second phase of penetration, the second end 48 of each cam 26 engages the device mount 36 and pivots the cam 26 relative to the respective bearing member 32 with further movement in the direction from the first position toward the second position. Each cam 26 includes a second bearing or roller 50 mounted on the second end 48 thereof, and engageable with the device mount 36 to facilitate movement of the cam 26 relative to the device mount 36. As shown typically in FIG. 3, the first or upper end 46 of each cam may form an arcuate surface defining a curvature that approximately matches the curvature of the respective bearing 32 to facilitate engaging the bearing 32 and retaining the cam in the locked position.

As can be seen, each septum 14 defines an interior surface 15 in fluid communication with the chamber 16. Each stop 40 prevents movement of the closure 22 through the interior surface 15 of the septum 14, but allows movement of the penetrating tip 20 and port(s) 24 through the interior surface and into fluid communication with the chamber 16.

Figure 10:
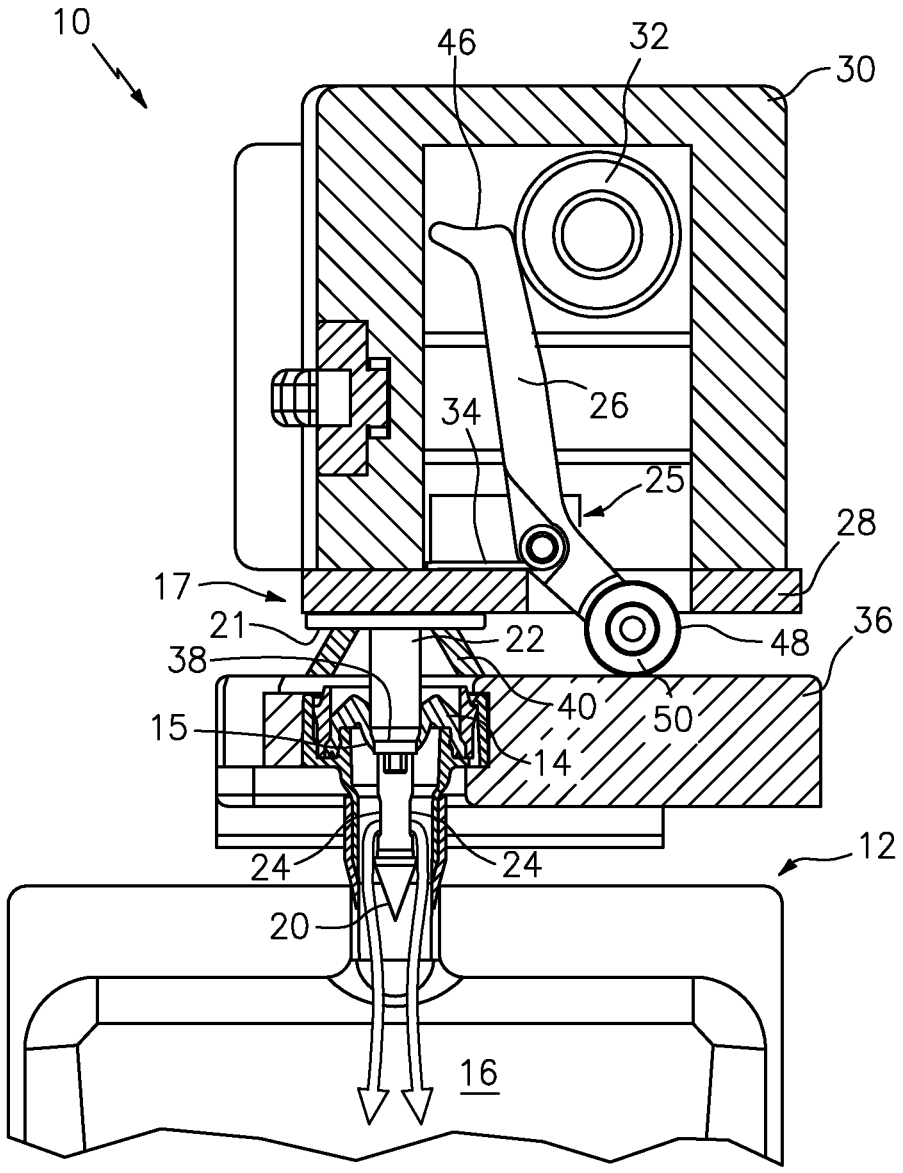
FIG. 10 shows the filling member mounting assembly, needle and septum in the second phase of penetration, during which a peristaltic pump (or other type of pump) pumps the product to be filled into the sterile chamber when the needle is fully open, and wherein the arrows illustrate the pumped product flowing through the needle eyes and into the sterile chamber.
Figure 11:
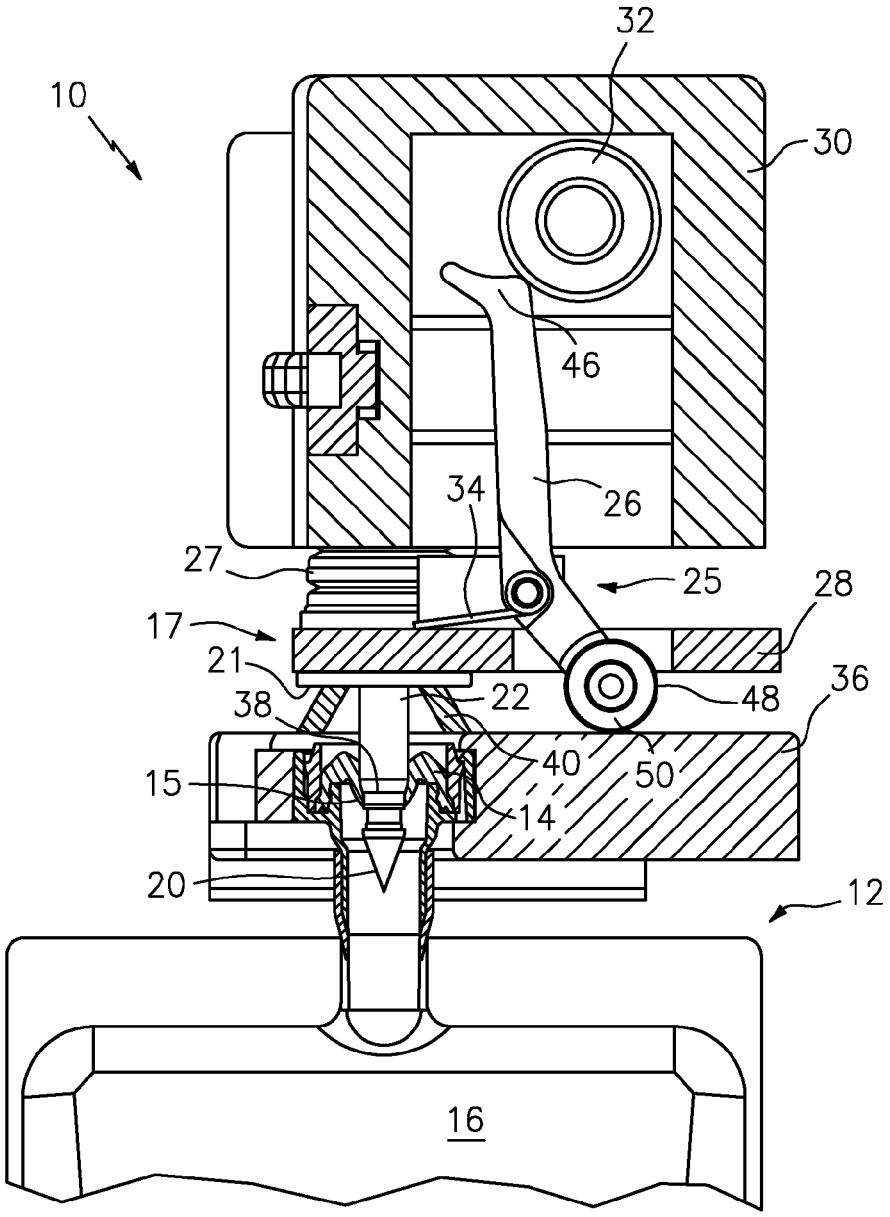
FIG. 11 shows the filling member mounting assembly, needle and septum during the first phase of withdrawal of the needle, wherein the compression plate is biased against the shutter, and the cam is biased toward the locked position to prevent withdrawal of the shutter and allow the needle eyes to move into the closed and sealed position prior to withdrawal through the septum.
Figure 12:
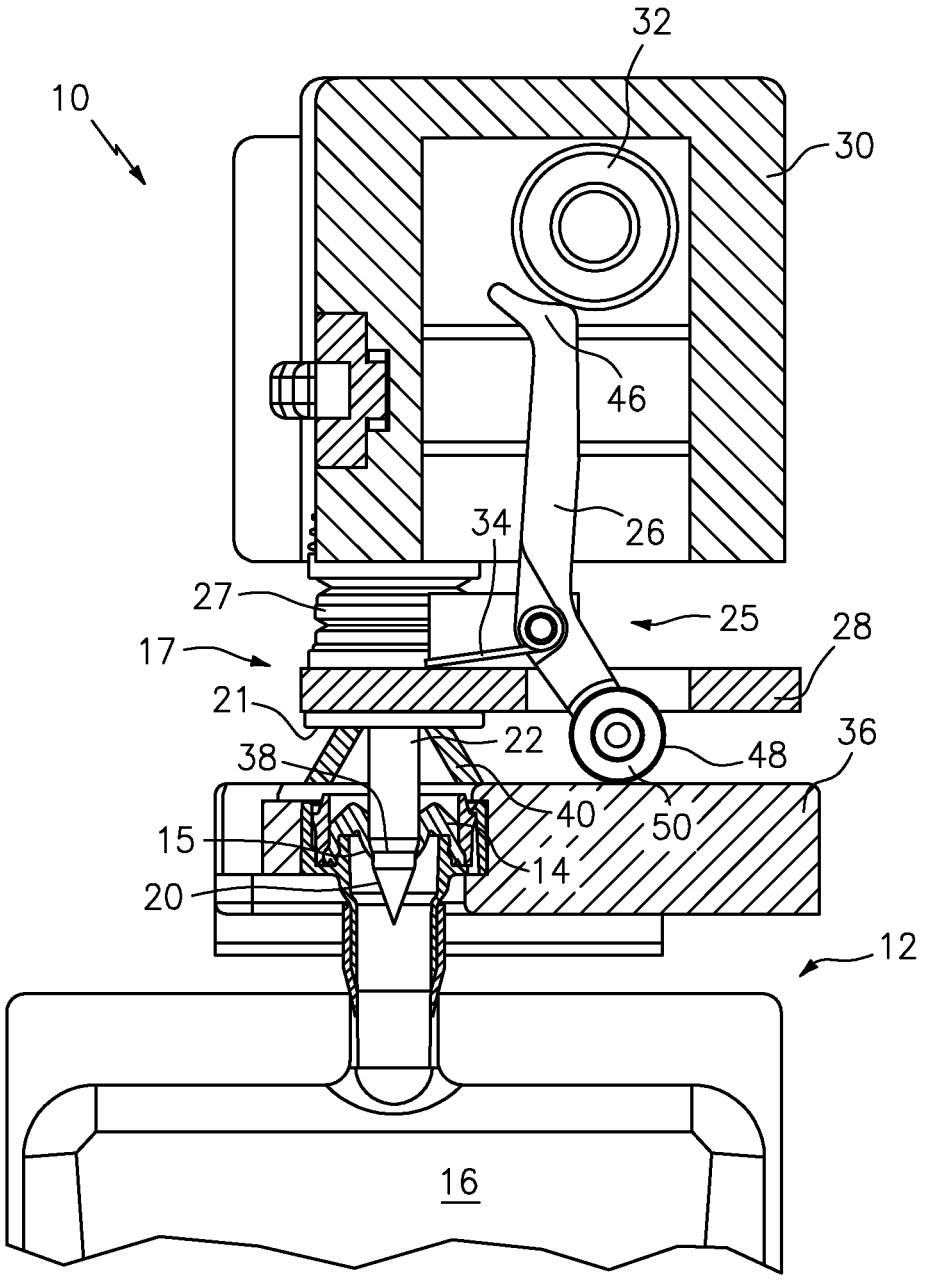
FIG. 12 shows the filling member mounting assembly, needle and septum during the first phase of withdrawal of the needle, wherein the needle and shutter are nearly fully locked in the closed position prior to withdrawal of the needle eyes through the septum.
Figure 13:
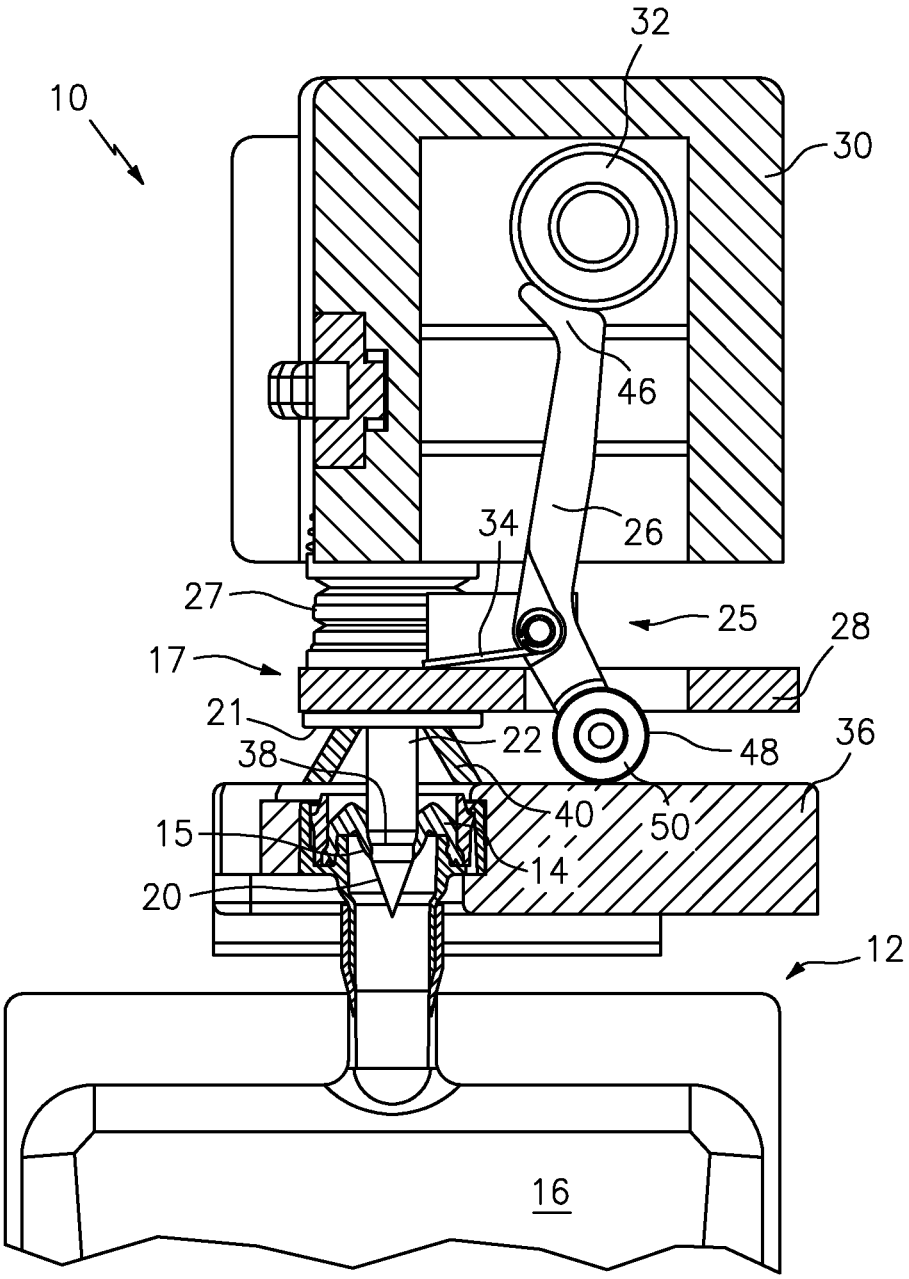
FIG. 13 shows the filling member mounting assembly, needle and septum at the start of the second phase of withdrawal of the needle, wherein the needle and shutter are fully locked in the closed position.
Figure 14:
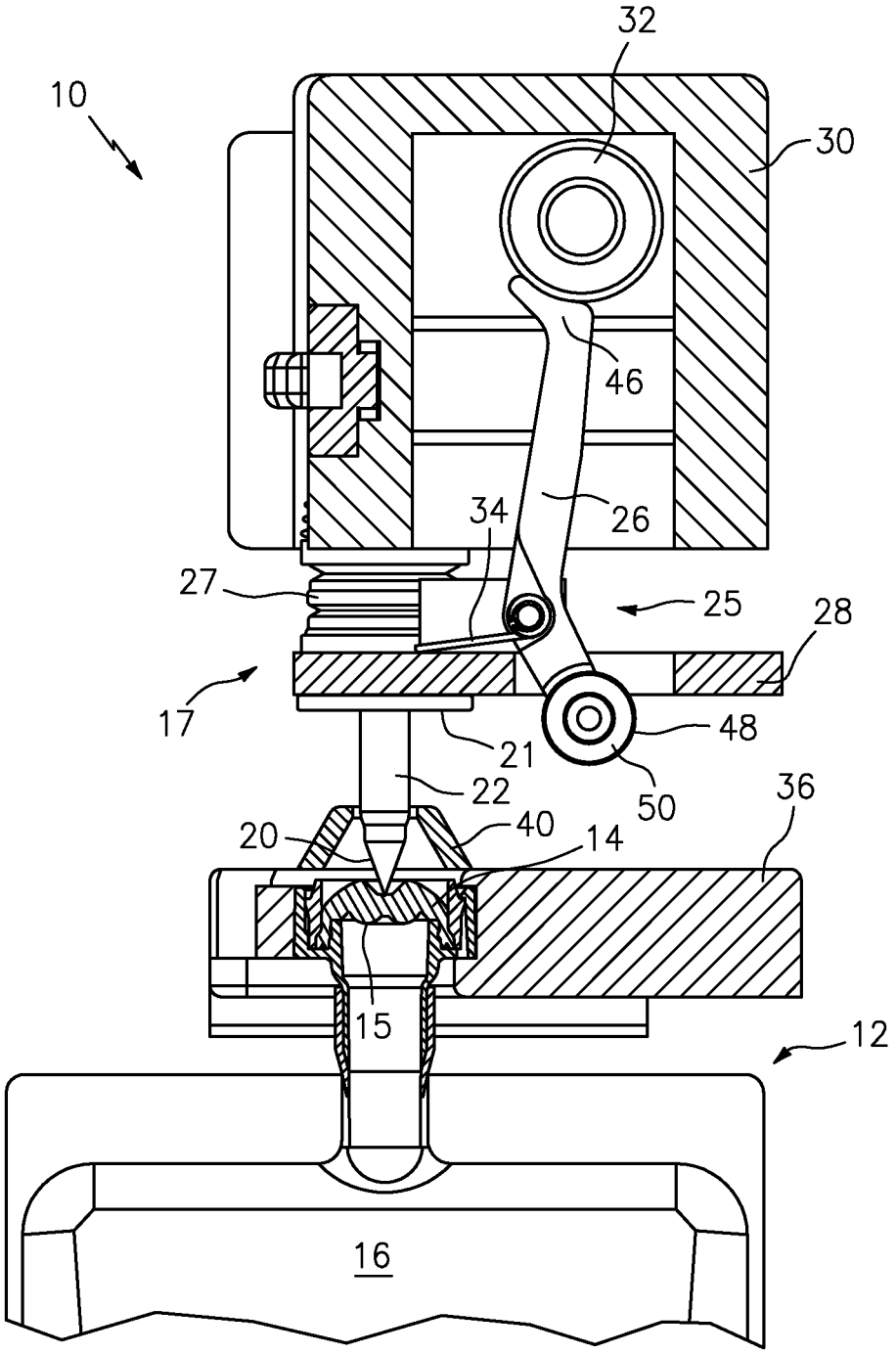
FIG. 14 shows the filling member mounting assembly, needle and septum during the second phase of withdrawal of the needle, wherein the needle and shutter are locked in the closed position and located almost fully outside of the septum.
Figure 15:
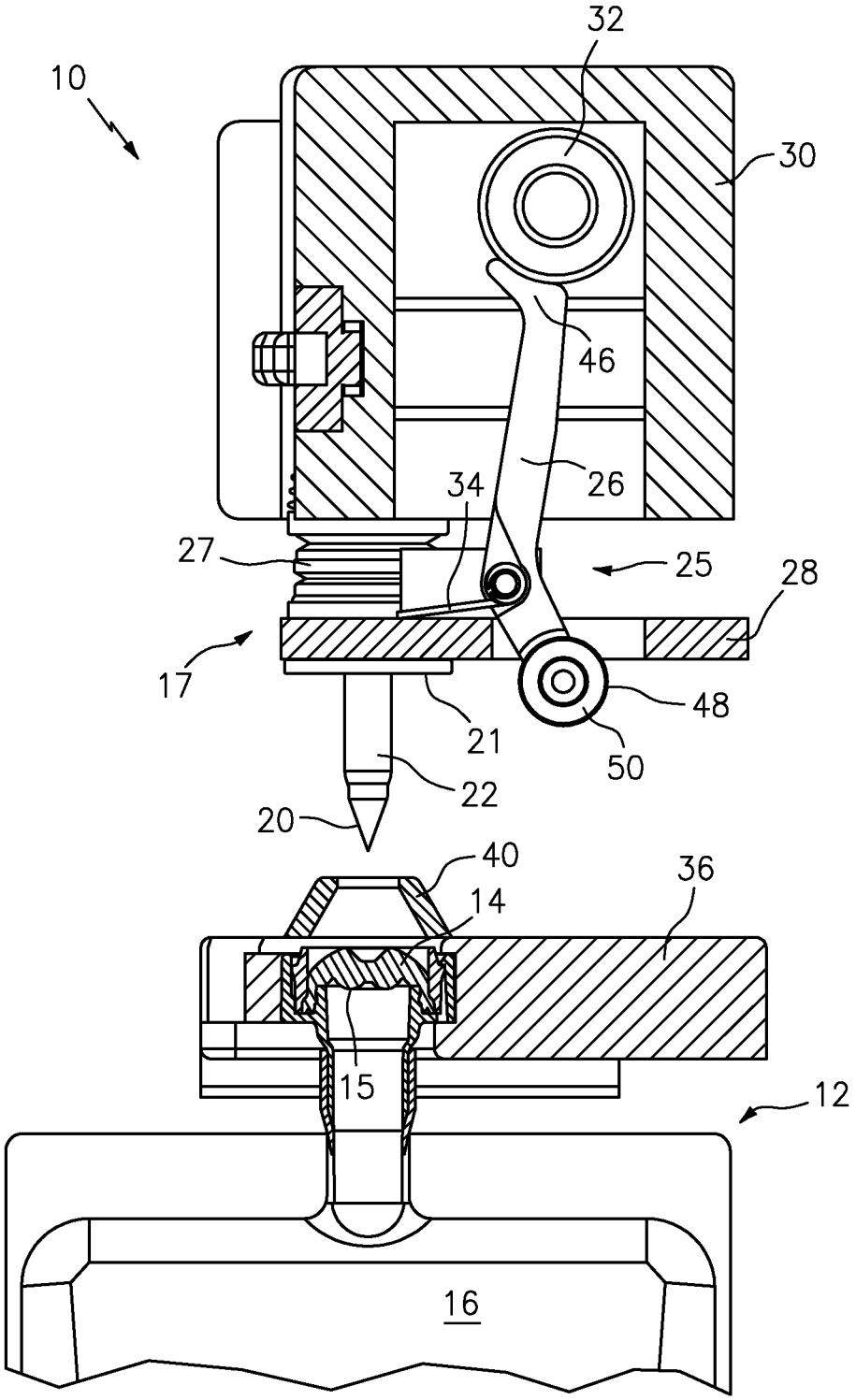
FIG. 15 shows the filling member mounting assembly, needle and septum during the second phase of withdrawal of the needle, wherein the needle and shutter are locked in the closed position and the needle is returned to the start position and ready to fill another device.

A method of operation of the apparatus 10 to fill one or more devices 12, such as sterile or aseptic filling of sterile or aseptic chambers 16 of such devices, includes the following steps:

Penetrating each septum 14 with the penetrating tip 20 of a respective closed filling member 18;

During the first phase of penetration of the septum 14 (see FIGS. 4-6), locking the filling member 18 and the closure 22 in the closed position, with the closure 22 closing the port(s) 24 and forming a fluid-tight seal between the port(s) 24 and ambient atmosphere to maintain sterility of the port(s) and the interior of the filling member 18; and During the second phase of penetration of the septum 14 (see FIGS. 7-10), unlocking and allowing further movement of the filling member 18 relative to the closure 22, and opening the port(s) 24 into fluid communication with the chamber 16 of the device 12, such as the sealed, empty sterile or aseptic chamber 16 of the device 12; and Introducing a flow of substance through the open port(s) 24 of the filling member 18 and into the sealed, sterile or aseptic chamber 16 of the device 12 (see FIG. 10).

The method further includes terminating the flow of substance through the port(s) 24, withdrawing the filling member 18 from the septum 14, and allowing the septum 14 to reseal itself upon withdrawal of the filling member 18 therefrom (see FIGS. 11-15).

The method of operation further includes: during a first phase of withdrawal (see FIGS. 11 and 12), moving the filling member 18 relative to the closure 22 and into the closed position with the closure 22 closing the port(s) 24 and forming a fluid-tight seal between the port(s) 24 and ambient atmosphere to maintain sterility of the port(s) 24 and the interior of the filling member 18; and during a second phase of withdrawal (see FIGS. 13-15), locking the filling member 18 and the closure 22 in the closed position.

As can be seen, the shutter or closure 22 defines a tip 38 at the juncture of the shutter and penetrating tip 20 of the hollow filling member 18, and the septum 14 defines an interior surface 15 in communication with the interior of the chamber 16. During the second phase of penetration, the tip 38 of the closure 22 is preferably maintained within the septum 14 and prevented from penetrating through the interior surface 15 of the septum 14.

The method of operation preferably further includes resealing the resulting penetration aperture in the septum 14 by any one or more of applying radiation, thermal energy, liquid sealant, or a chemical agent thereto, or by mechanical resealing.

The filling needle assembly, fillers and methods described herein may take the form of any of the filling members or assemblies, fillers and methods disclosed in any of the following co-pending patent applications that are hereby expressly incorporated by reference in their entireties as part of the present disclosure: U.S. patent application Ser. No. 13/450,306, filed Apr. 18, 2012, entitled "NEEDLE WITH CLOSURE AND METHOD;" U.S. patent application Ser. No. 14/214,890, filed Mar. 15, 2014, entitled "CONTROLLED NON-CLASSIFIED FILLING DEVICE AND METHOD"; and U.S. patent application Ser. No. 13/917,562, filed Jun. 13, 2013, entitled "DEVICE WITH PENETRABLE SEPTUM, FILLING NEEDLE AND PENETRABLE CLOSURE, AND RELATED METHOD."

As may be recognized by those of ordinary skill in the pertinent art based on the teachings herein, numerous changes and modifications may be made to the above-described and other embodiments of the present invention without departing from its scope as defined in the claims. In particular, the locking device 25 may take any of numerous different forms or configurations that are currently known or that later become known. In another embodiment, each cam is pivotally mounted on one end to the filling member mount 30, and includes a bearing member at the other end which is slidably engageable with the compression plate 28. A spring, such as a torsion spring, normally biases the cam and its bearing member into the locked position wherein the cam engages the compression plate, and the compression plate engages the lower flange of the respective closure to prevent relative movement of the hollow filling member and closure. During the second phase of penetration, the filling member mount is moved relative to the compression plate which, in turn, causes the cam to pivot against the bias of its spring from the locked into the unlocked position. During this pivotal movement, the bearing member of the cam slidably engages the compression plate to facilitate the pivotal movement. In another embodiment, the locking device 25 is electrically or electro-mechanically actuated, and/or includes an optical or other type of sensor to sense the position of the closure 22 and/or the filling member 18 and lock and unlock the closure 22 and the filling member 18 in accordance with the above teachings.

In addition, the components of the filling apparatus 10 and the device to be filled 12 may take any of numerous different configurations, or may be made of any of numerous different materials, that are currently known, or that later become known. For example, rather than taking the form of a needle, the filling member 18 could take the form of a cannula. The device to be filled 12, on the other hand, could include a one-way filling valve, and an elastic septum that receives the filling cannula, forms an annular interface with the filling cannula, and decontaminates the filling cannula prior to opening the closure or other enclosure on the cannula, engaging the one-way valve, and filling the sterile chamber of the device. The filling apparatus 10 likewise may be employed in any of numerous different configurations, driven into and out of engagement with the devices to be filled in any of numerous different ways, and the filled devices may be transported on any of numerous different types of conveyors or in other ways. Similarly, the devices to be filled may take the form of any of numerous different containers or devices that are currently known, or that later become known, such as vials, pouches, tubes, syringes, single dose delivery devices, and multiple dose delivery devices. Also, the filling apparatus 10 may be used to inject any of numerous different types of fluids or other substances into the devices 12 for any of numerous different applications, including, for example, medicaments, pharmaceuticals, vaccines, liquid nutrition products, supplements, and numerous other products that are currently known, or that later become known. In addition, the filling process may take place in any of numerous different types of ambient environments defining any of numerous different types of contamination or sterility assurance levels. Accordingly, this detailed description of embodiments is to be taken in an illustrative, as opposed to a limiting sense.

What is claimed is:

1. An apparatus for transferring substance into a device including a penetrable septum and a chamber in fluid communication with the penetrable septum, comprising:

a hollow filling member, a penetrating tip formed at one end of the filling member that is engageable with the penetrable septum to penetrate the septum, at least one port in fluid communication between an interior of the hollow filling member and an exterior of the hollow filling member, and a closure, wherein (A) one or more of the closure or filling member is movable between (i) a first position wherein the closure closes the at least one port and forms a fluid-tight seal between the at least one port and ambient atmosphere to maintain sterility of the at least one port and the interior of the filling member, and (ii) a second position opening the at least one port to allow substance to pass between said interior and said exterior; and (B) one or more of the filling member or septum is movable relative to the other between (i) a first position wherein the penetrating tip is not penetrating the septum, and (ii) a second position wherein the penetrating tip is penetrated through the septum and in communication with the chamber of the device; and a locking device movable between (i) a locked position locking one or more of the closure or filling member in the first position wherein the closure closes the at least one port, and (ii) an unlocked position allowing movement of one or more of the closure or filling member relative to the other and into the second position opening the at least one port.

2. An apparatus as defined in claim 1, further comprising a filling member mount, wherein the hollow filling member is mountable thereto and the filling member mount is movable with the filling member between (i) the first position wherein the penetrating tip is not penetrating the septum, and (ii) the second positions wherein the penetrating tip is penetrated through the septum.

3. An apparatus as defined in claim 2, wherein the locking device includes a compression plate engageable with the closure, and wherein one or more of the filling member mount or compression plate is movable relative to the other.

4. An apparatus as defined in claim 3, wherein the locking device further includes a cam movable between (i) a locked position preventing movement of the filling member relative to the compression plate and closure, and (ii) an unlocked position allowing movement of the filling member relative to the compression plate and closure.

5. An apparatus as defined in claim 4, wherein the cam defines a plurality of unlocked positions depending on a degree of movement of the filling member relative to the compression plate and closure.

6. An apparatus as defined in claim 4, wherein the filling member mount includes a bearing member, and the cam is pivotally mounted adjacent to and engageable with the bearing member.

7. An apparatus as defined in claim 6, wherein (i) in the locked position of the cam, the cam is engaged with the bearing member and the compression plate to prevent movement of the compression plate relative to the filling member mount, and (ii) in the unlocked position of the cam, the cam is movable relative to the bearing member to allow movement of one or more of the filling member mount or compression plate relative to the other.

8. An apparatus as defined in claim 3, further comprising a spring that biases the compression plate against the closure.

9. An apparatus as defined in claim 4, wherein the cam is pivotally mounted, the compression plate is spring biased against the closure, and the filling member is movable relative to the closure against the bias of a spring.

10. An apparatus as defined in claim 9, wherein the cam includes a bearing member that facilitates pivotal movement of the cam and movement of the filling member relative to the closure.

11. An apparatus as defined in claim 3, further comprising a device mount, wherein the device is mountable thereto, and the filling member mount is movable relative to the device mount between (i) the first position wherein the penetrating tip is not penetrating the septum, and (ii) the second position wherein the penetrating tip is penetrated through the septum and in communication with the chamber of the device.

12. An apparatus as defined in claim 11, wherein during a first phase of penetration of the septum by the penetrating tip, the locking device is in its locked position, and during a second phase of penetration, the locking device is in its unlocked position.

13. An apparatus as defined in claim 12, wherein the closure defines a tip at a juncture of the closure and penetrating tip, and the septum defines an interior surface in communication with an interior of the chamber, and during the second phase of penetration, the tip of the closure is located within the septum and is prevented from penetrating through the interior surface.

14. An apparatus as defined in claim 13, wherein the device mount includes a stop engageable with one or more of the closure or compression plate to prevent further movement of the closure in a direction from the first position wherein the closure closes the at least one port toward the second position opening the at least one port, during the first phase of penetration neither the closure nor the compression plate is engaged with the stop, and during the second phase of penetration one or more of the closure or compression plate is engaged with the stop.

15. An apparatus as defined in claim 14, wherein the locking device further includes a cam movable between (i) a locked position preventing movement of the filling member relative to the compression plate and closure, and (ii) an unlocked position allowing movement of the filling member relative to the compression plate and closure, and the cam includes a first end engageable with a bearing member, and a second end engageable with the device mount.

16. An apparatus as defined in claim 15, wherein during the second phase of penetration, the second end of the cam engages the device mount and pivots the cam relative to the bearing member with further movement in the direction from the first position wherein the closure closes the at least one port toward the second position opening the at least one port.

17. An apparatus as defined in claim 4, wherein the cam is pivotally mounted on the filling member mount, and includes a bearing engageable with the compression plate, and a spring that biases the cam into its locked position, and that allows pivotal movement of the cam relative to the compression plate against the bias of the spring in its unlocked position.

18. An apparatus as defined in claim 17, wherein the septum defines an interior surface in fluid communication with the chamber, and a stop prevents movement of the closure through the interior surface of the septum, but allows movement of the penetrating tip and at least one port through the interior surface and into fluid communication with the chamber.

19. An apparatus as defined in claim 16, wherein the cam includes a second bearing member mounted on the second end thereof, and engageable with the device mount to facilitate movement of the cam relative to the device mount.

20. An apparatus for transferring substance into a device with a filling member assembly, wherein the device includes a penetrable septum and a chamber in fluid communication with the penetrable septum, and the filling member assembly includes a hollow filling member, a penetrating tip formed at one end of the filling member that is engageable with the penetrable septum to penetrate the septum, at least one port in fluid communication between an interior of the hollow filling member and an exterior of the hollow filling member, and a closure, wherein (A) one or more of the closure or filling member is movable between (i) a first position wherein the closure closes the at least one port and forms a fluid-tight seal between the at least one port and ambient atmosphere to maintain sterility of the at least one port and the interior of the filling member, and (ii) a second position opening the at least one port to allow substance to pass between said interior and said exterior; and (B) one or more of the filling member or septum is movable relative to the other between (i) a first position wherein the penetrating tip is not penetrating the septum, and (ii) a second position wherein the penetrating tip is penetrated through the septum and in communication with the sealed chamber of the device; the apparatus comprising:

a locking device movable between (i) a locked position locking one or more of the closure or filling member in the first position wherein the closure closes the at least one port, and (ii) an unlocked position allowing movement of one or more of the closure or filling member relative to the other and into the second position opening the at least one port.

21. An apparatus for transferring substance into a device including a penetrable septum and a chamber in fluid communication with the penetrable septum, comprising:

first means for filling that is engageable with the penetrable septum for penetrating the septum, and including second means for placing an interior of the first means in fluid communication with an exterior of the first means;

third means for closing and opening the second means, wherein (A) one or more of the third means or first means is movable between (i) a first position wherein the third means closes the second means and forms a fluid-tight seal between the second means and ambient atmosphere to maintain sterility of the second means and the interior of the first means, and (ii) a second position opening the second means to allow substance to pass between said interior and said exterior; and (B) one or more of the first means or septum is movable relative to the other between (i) a first position wherein the first means is not penetrating the septum, and (ii) a second position wherein the first means is penetrated through the septum and the second means is in communication with the sealed chamber of the device; and fourth means movable between (i) a locked position for locking one or more of the third means or first means in the first position wherein the third means closes the second means, and (ii) an unlocked position for allowing movement of one or more of the third means or first means relative to the other and into the second position opening the second means.

22. A apparatus as defined in claim 21, wherein the first means is a needle, the second means is a port, the third means is a closure, and the fourth means is a locking device.

23. A method of transferring substance into a device including a penetrable septum and a chamber in fluid communication with the penetrable septum, comprising:

penetrating the septum with a penetrating tip of a hollow filling member including at least one port adjacent to the penetrating tip in fluid communication between an interior and an exterior of the hollowing filling member, and a closure, wherein the penetrating tip is formed at one end of the filling member and engageable with the penetrable septum to penetrate the septum and (A) one or more of the closure or filling member is movable between (i) a first position wherein the closure closes the at least one port and forms a fluid-tight seal between the at least one port and ambient atmosphere to maintain sterility of the at least one port and the interior of the filling member, and (ii) a second position opening the at least one port to allow substance to pass between said interior and said exterior; and (B) one or more of the filling member or septum is movable relative to the other between (i) a first position wherein the penetrating tip is not penetrating the septum, and (ii) a second position wherein the penetrating tip is penetrated through the septum and in communication with the sealed chamber of the device;

during a first phase of penetration of the septum, locking one or more of the filling member or closure in a closed position with the closure closing the at least one port and forming a fluid-tight seal between the at least one port and ambient atmosphere to maintain sterility of the at least one port and the interior of the filling member using a locking device movable between (i) a locked position locking one or more of the closure or filling member in the first position wherein the closure closes the at least one port, and (ii) an unlocked position allowing movement of one or more of the closure or filling member relative to the other and into the second position opening the at least one port;

during a second phase of penetration of the septum, unlocking and allowing relative movement of one or more of the closure or filling member relative to the other, and opening the at least one port into fluid communication with the chamber of the device; and introducing a flow of substance through the open at least one port of the hollow filling member and into the device.

24. A method as defined in claim 23, further comprising terminating the flow of substance through the at least one port, withdrawing the hollow filling member from the septum, and allowing the septum to reseal itself upon withdrawal of the hollow filling member therefrom.

25. A method as defined in claim 23, further comprising:

during a first phase of withdrawal, moving the filling member relative to the closure and into the closed position with the closure closing the at least one port and forming a fluid-tight seal between the port and ambient atmosphere to maintain sterility of the at least one port and the interior of the filling member; and during a second phase of withdrawal, locking one or more of the filling member or the closure in the closed position.

26. A method as defined in claim 23, wherein the closure defines a tip at a juncture of the closure and penetrating tip, and the septum defines an interior surface in communication with an interior of the chamber, and during the second phase of penetration, maintaining the tip of the closure within the septum and preventing the tip of the closure from penetrating through the interior surface of the septum.

27. A method as defined in claim 23, further comprising resealing the resulting penetration aperture in the septum by one or more of applying radiation, thermal energy, liquid sealant or a chemical agent thereto, or by mechanical resealing.

28. A method as defined in claim 23, further comprising, during the locking step, engaging one or more of the filling member or the closure with the locking device to lock said one or more of the filling member or closure in the first position, and, during the unlocking step, disengaging the locking device from said one or more of the filling member or the closure to allow said movement of one or more of the filling member or closure relative to the other and into the second position opening the at least one port.

29. A method as defined in claim 23, further including allowing movement of one or more of the filling member or closure relative to the septum in the locked position.

30. An apparatus as defined in claim 1, wherein, in the locked position, the locking device engages one or more of the filling member or the closure to lock said one or more of the filling member or closure in the first position, and, in the unlocked position, the locking device is disengaged from said one or more of the filling member or the closure to allow said movement of one or more of the filling member or closure relative to the other and into the second position opening the at least one port.

31. An apparatus as defined in claim 1, wherein, in the locked position, one or more of the filling member or closure is movable relative to the septum.

32. An apparatus as defined in claim 20, wherein, in the locked position, the locking device engages one or more of the filling member and the closure to lock said one or more of the closure or filling member in the first position, and, in the unlocked position, the locking device is disengaged from said one or more of the filling member and the closure to allow said movement of one or more of the closure or filling member relative to the other and into the second position opening the at least one port.

33. An apparatus as defined in claim 20, wherein, in the locked position, one or more of the filling member or closure is movable relative to the septum.

34. An apparatus as defined in claim 21, wherein, in the locked position, the fourth means engages one or more of the first means and the third means to lock said one or more of the third means or first means in the first position, and, in the unlocked position, the fourth means is disengaged from said one or more of the first means and the third means to allow said movement of one or more of the third means or first means relative to the other and into the second position opening the second means.

35. An apparatus as defined in claim 21, wherein, in the locked position, one or more of the filling member or closure is movable relative to the septum.

* * * * *